US005181286A

United States Patent [19]

McNulty

[11] Patent Number: 5,181,286

[45] Date of Patent: Jan. 26, 1993

[54] OPTIONAL BED ARRANGEMENT FOR SHIP STATEROOM USE

[76] Inventor: John F. McNulty, 473 S. Ithan Ave., Rosemont, Pa. 19010

[21] Appl. No.: 814,378

[22] Filed: Dec. 26, 1991

[51] Int. Cl.[5] ..... A47C 17/34

[52] U.S. Cl. ..... 5/8; 5/118; 5/185; 114/189; 297/67

[58] Field of Search ..... 5/8, 9.1, 181, 185, 5/118, 53.2, 59.1; 296/174; 114/71, 188, 189; 297/63, 67

[56] References Cited

U.S. PATENT DOCUMENTS

| | | | |
|---|---|---|---|
| 316,013 | 4/1885 | Cutler | 297/67 |
| 988,513 | 4/1911 | Shea et al. | 297/67 X |
| 995,234 | 6/1911 | Emerson | 297/67 |
| 2,504,645 | 4/1950 | Burnett | 297/67 |
| 2,522,186 | 9/1950 | McHenry | 5/465 |
| 3,738,699 | 6/1973 | Fain | 5/118 X |
| 3,790,973 | 2/1974 | Bradley | 5/53.2 |
| 3,880,458 | 4/1975 | Jackson | 297/63 |
| 4,879,962 | 11/1989 | Lathers | 114/189 X |

*Primary Examiner*—Michael F. Trettel
*Attorney, Agent, or Firm*—Paul & Paul

[57] ABSTRACT

A bed arrangement is provided for shipboard stateroom use. Fixedly positioned, spaced-apart, small single beds, having a leg space therebetween for daytime use as facing sofas, optionally can be converted to a large common bed, of a size larger in width than even a conventional king-size bed. This option allows booking flexibility in that the same stateroom can at different times be booked as providing separate, single beds, or optionally as providing a large common bed, comparable to or greater in size than that of a king-size bed. The option is effected by providing a readily assembleable and readily removable center bed section in the space between the normally spaced-apart separate beds. The invention thereby provides a means for increasing stateroom revenue in response to demand for large, shared bedding arrangements, when such demand occurs.

14 Claims, 3 Drawing Sheets

OPTIONAL BED ARRANGEMENT FOR SHIP STATEROOM USE

BACKGROUND OF THE INVENTION

In shipboard sleeping arrangements, and most particularly, on cruise ships, stateroom space is customarily very compact, generally to allow a maximum amount of room in the shipboard common areas, for entertainment, dining, sports facilities, etc. In fact, typically the furniture, plumbing fixtures, closets, etc. in shipboard staterooms very efficiently utilize the space allotted to the staterooms, often in having smaller-than-usual furniture, fixtures, etc.

In addition, stateroom beds, furniture and the like are generally fixedly mounted to the deck, bulkhead or the like, to prevent them from being tossed about as the result of the motion of the ship in response to weather, conditions of the sea, etc.

Because it is not known in advance what the booking needs of a given ship, especially a cruise ship, are going to be at the time that the ship is built, there is a tendency when ships are built to outfit staterooms with a pair of spaced-apart individual beds that are as small as, or generally smaller than conventional "single" size beds, rather than to outfit them with "double"-size beds, "queen"-size or "king"-size beds. The rational seems to be that customers who would prefer a common bed, such as a double bed, queen-size bed or a king-size bed can more readily be satisfied if they have to forego their preference and make do with separate beds, than can customers who want separate beds be satisfied if only a common bed is available for accommodating two people. This is especially understandable when one considers that the booking practices of most cruise lines is that, in the case of passengers traveling alone, such can or will be booked to share a room with a stranger, in order for such customer to avoid having to pay a cruise cost approaching that which would be charged for two people, as would be the case, for example, should a passenger insist upon not sharing a room.

There are many other reasons why passengers may prefer separate arrangements, as distinguished from common sleeping arrangements, or the converse. Such reasons can include people of substantial size desiring the comforts of a large, common bed, rather than small, separate beds, couples accustomed to sharing a common bed, people who do not care to share a bed with another person whether they are strangers or not, etc.

SUMMARY OF THE INVENTION

The present invention is directed to providing optional versatility in ship stateroom sleeping arrangements, by converting spaced-apart separate beds, that also generally function as sofas or the like, into a large common bed arrangement, and the converse. This allows the prospect of enhanced profitability by optimizing the ability to meet the bedding preferences of substantially all passengers.

Accordingly, it is a primary object of this invention to provide versatility in bed arrangements for shipboard use, to allow conversion of relatively narrow individual beds that are not easy moved together, into a larger, single common bed arrangement.

It is a further object of the invention to accomplish the above object by providing a center bed portion suitable for disposition between a pair of spaced-apart individual beds.

It is another object of this invention to accomplish the above objects, in the setting of a cruise ship stateroom.

It is another object of this invention to provide a ship having staterooms that are readily convertible between a pair of spaced-apart narrow beds and a bedding arrangement having a larger bed than the total size of the two spaced-apart beds.

It is yet another object of the present invention to provide a process for optimizing shipboard flexibility by providing for an optional center bed portion for use between a pair of generally fixedly mounted spaced-apart separate beds, whereby a given stateroom can readily be converted between spaced-apart separate smaller beds and a single larger bed, for accommodating the needs of different users.

Other objects of the invention will be readily apparent upon reading the following brief descriptions of the drawing figures, the detailed descriptions of the preferred embodiments, and the appended claims.

BRIEF DESCRIPTIONS OF THE DRAWING FIGURES

DETAILED DESCRIPTION OF THE PREFERRED EMBODIMENTS

Figure 1:
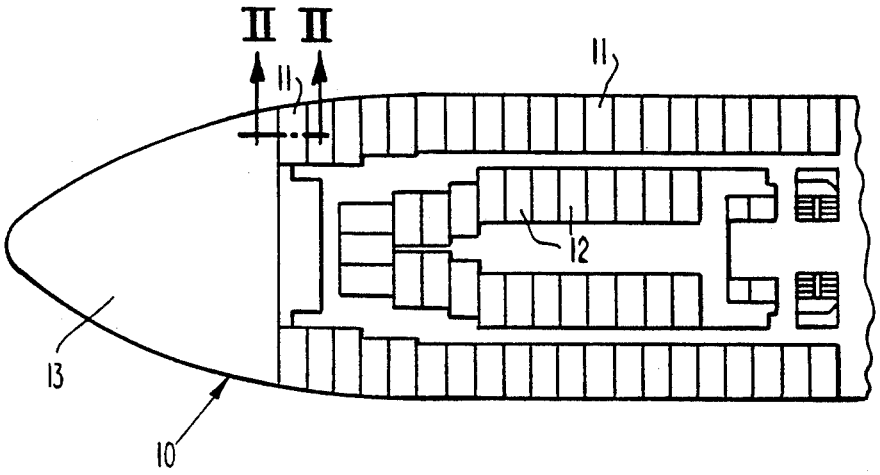
FIG. 1 is a fragmentary schematic plan view of a forward end of a cruise ship, illustrating the outlines of staterooms, on a given deck.

Referring now to the drawings in detail, reference is first made to FIG. 1, wherein a ship is generally designated by the numeral 10, and wherein on the given deck on the ship illustrated, a plurality of outer and inner staterooms 11 and 12, respectively, are illustrated, to the right of the bow 13 of the ship.

Figure 2:
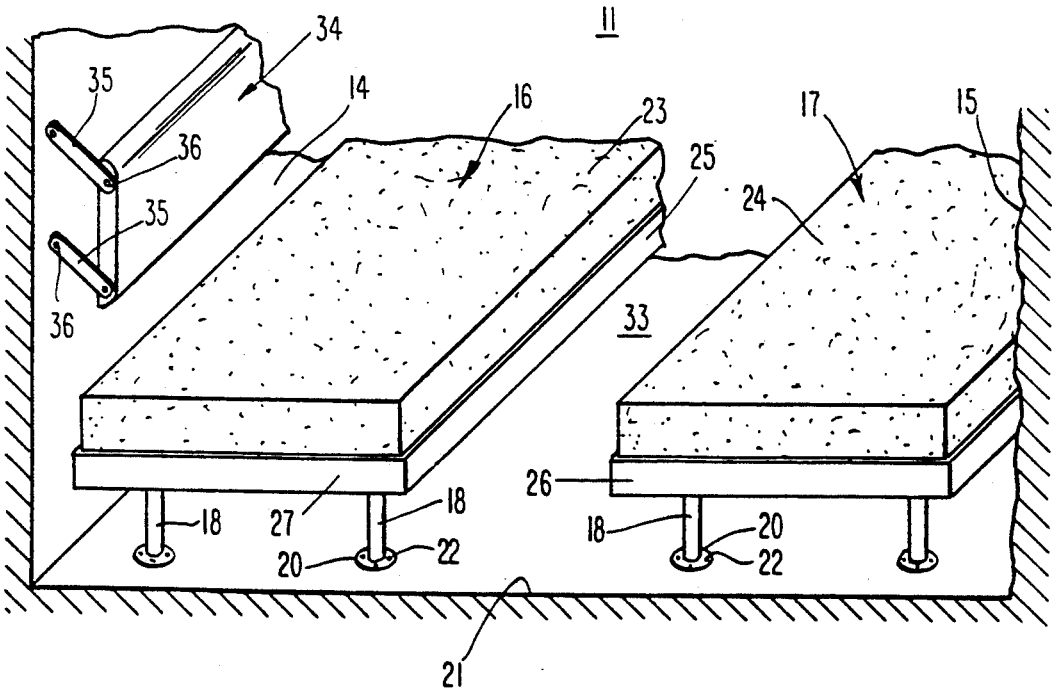
PRIOR ART Fig. 2
FIG. 2 is a fragmentary sectional view through a stateroom of a prior art design, taken generally along the line II—II of FIG. 1, and wherein a pair of spaced-apart individual beds mounted to the deck are illustrated in perspective.
Figure 2A:
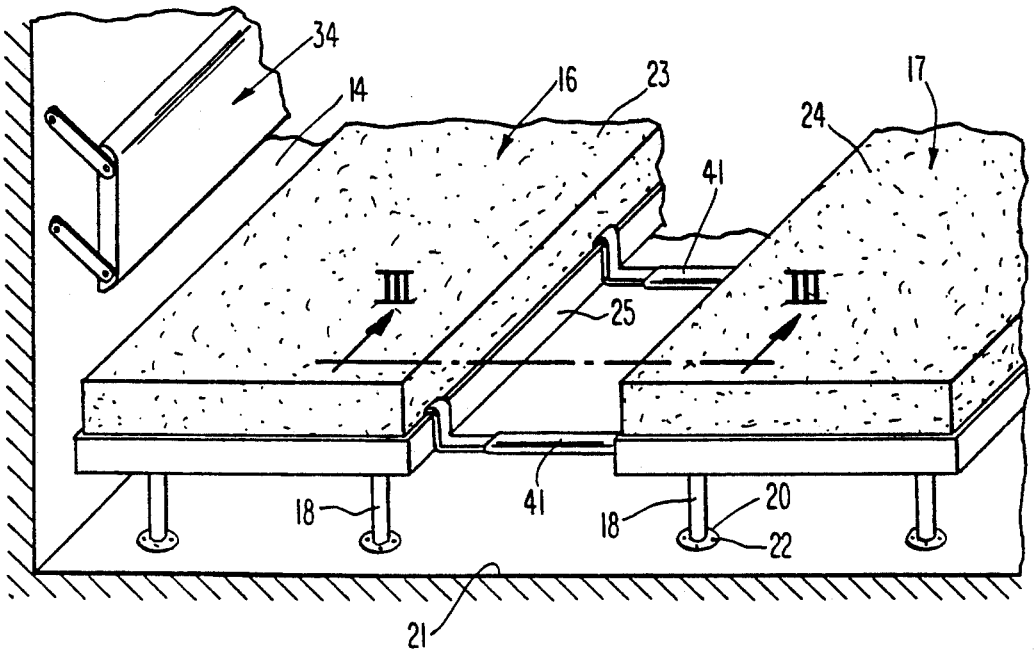
FIG. 2A is a view similar to that of FIG. 2, but wherein supports are illustrated between the two individual beds, for carrying a center bed portion that comprises a portion of this invention, therebetween.

With particular reference to FIG. 2, it will be seen that there are disposed against opposing bulkheads 14, 15, a pair of spaced-apart separate beds 16, 17, respectively, suitably fixedly mounted in position, so as not to move about the stateroom 11 due to the movement of a ship. One such means for mounting the beds may comprise carrying the beds on legs 18 that are captured in collars 20 that are fastened to the deck 21 by means of suitable fasteners 22.

Generally, in such staterooms, the separate beds are provided to be generally parallel to each other and in congruent relation to each other, with their upper sleeping surfaces disposed in generally coplanar relation in a given plane. This allows the efficient use of space by having the ends of the beds also lying in a common plane.

Figure 3:
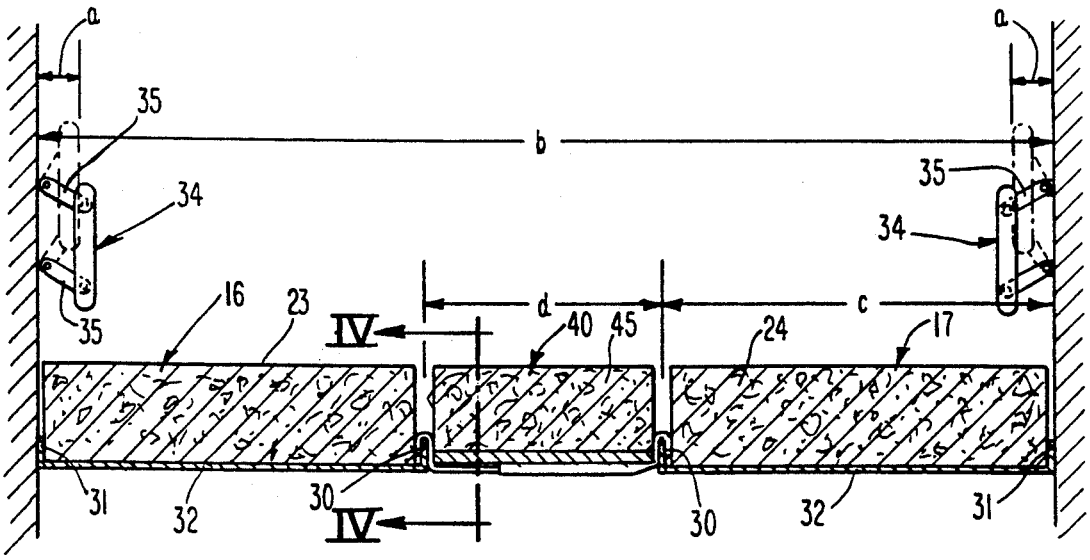
FIG. 3 is a vertical sectional view taken through a pair of spaced-apart separate beds and a central bed portion, generally along the line III—III of FIG. 2A, wherein the two spaced-apart beds and the center bed portion comprise a single large common bed.

Each bed 16, 17 may comprise a mattress 23, 24, carried in an associated bed frame, 25, 26. With reference also to FIG. 3, it will be seen that each bed frame 25, 26, may comprise upstanding end lips 27 at opposite ends, which end lips 27 are connected by inner and outer upstanding side lips 30 and 31, respectively. A suitable bottom 32 is provided between upstanding lips, forming a support for the mattress 23 or 24. Generally, the mattresses will be of conventional mattress foam or bedding with innerspring construction, as desired.

Because the separate beds 16, 17 generally function during daytime use as opposing couches, with the space 33 therebetween accommodating the legs of the persons sitting on the couches, back supports 34 are generally provided on the bulkheads 14, 15. The back supports are generally movably mounted by means of suitable pivot links 35 or the like, at opposite pivot ends 36 of the links 35, for facilitating the movements of the back supports 34, between the full line and phantom positions therefor shown in FIG. 3, with the full line positions of the back supports 34 being those positions utilized when the beds are to accommodate people sitting on the beds, needing back supports, and with the phantom positions accommodating out-of-way positions therefor, as for example, during sleeping use of the beds.

With particular reference to FIGS. 2A, 3, 4 and 5, it will be seen that a center bed section 40 is provided. The center section 40 is carried on a plurality of telescopically extensible center bed supports 41, with an inner support member 42 thereof slidably housed within an outer support member 43, for accommodating any variations in the size of the spacing between the two spaced-apart beds 16, 17.

Figure 4:
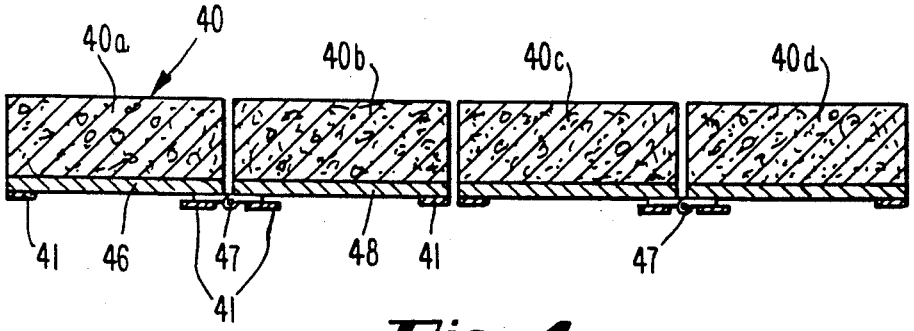
FIG. 4 is a longitudinal, vertical, sectional view taken through the central bed portion of FIG. 3, generally along the line IV—IV of FIG. 3.
Figure 5:
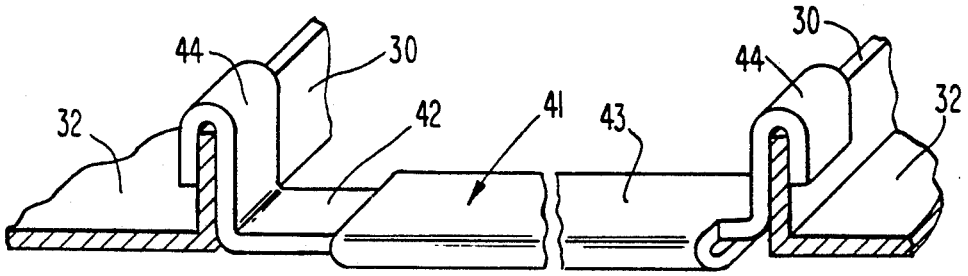
FIG. 5 is an enlarged perspective view of one of the central bed portion support members illustrated in FIG. 2A, shown to be telescopically expansable and retractable, with hook ends in engagement over upstanding bed rails of the spaced-apart individual beds better illustrated in FIG. 2A.

Opposite ends of the members 42 are constructed to be of inverted U-shape 44, as shown, to provide hooked-on engagement over upstanding side lips 30 of bed supports as shown in FIG. 5. Then, the center bed section or portion 40 can be disposed on top of the center section supports 41, as shown in FIGS. 3 and 4. The center bed section 40 will also have a mattress component 45, mounted on a generally horizontal support 46.

With particular reference to FIG. 4, it will be seen that throughout the length of the central bed portion 40, there are a plurality of sub-portions 40*a*, 40*b*, 40*c* and 40*d*. Each are mounted on a suitable horizontal support 46, that in turn, is carried by a pair of telescopic supports 41. For ease of storage, in the arrangement of FIG. 4, the central bed portion 40 is constructed as two pairs of such portions; one pair being comprised of bed portions 40*a* and 40*b*, and another being comprised of bed portions 40*c* and 40*d*, with each pair being hingedly connected by hinges 47, generally of the piano hinge type, connecting adjacent horizontal support portions 46.

Thus, when it is desired to have the stateroom arranged for daytime use, without a central bed portion in place, central bed portions 40*a* and 40*b* may be removed, folded with their horizontal support portions 46 in facing-together relation back upon each other, and stored beneath one of the beds 16, 17. Similarly, portions 40*c* and 40*d* may likewise be folded and stored, with the telescopic supports 41 then being removed from the space 33 between the beds 16, 17, also for storage, preferably beneath one or more of the beds 16, 17.

It will be apparent that, if desired, the central bed portion 40 may be constructed as a single unit running from head to toe of the beds, with its generally horizontal support 46 likewise running the length of the beds, and that such singular unit may be used as a backing support, or stored beneath the beds, as desired, when not in use.

Figure 6:
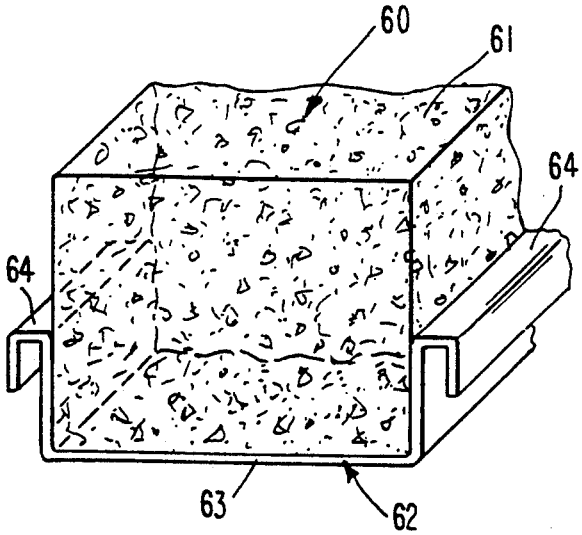
FIG. 6 is a fragmentary perspective view of an alternative central bed portion with its alternative supporting device, having alternative hook-ended mounting means.

With reference to FIG. 6, it will be seen that alternative constructions for this central bed portion 40 may also be provided. In the arrangement in FIG. 6, a central portion 60 is provided, in the form of a mattress portion 61 carried on a support 62. The support 62 may be comprised of an extrusion, for example, having unitary construction between its horizontal support portion 63 and its inverted U-shape hooks 64, for accommodating their receipt on the upstanding side lips of beds as aforesaid. In the arrangement of FIG. 6, the central bed portion 60 may be constructed as a single unit, running the length of the space between the beds, or multiple units, as desired.

Figure 7:
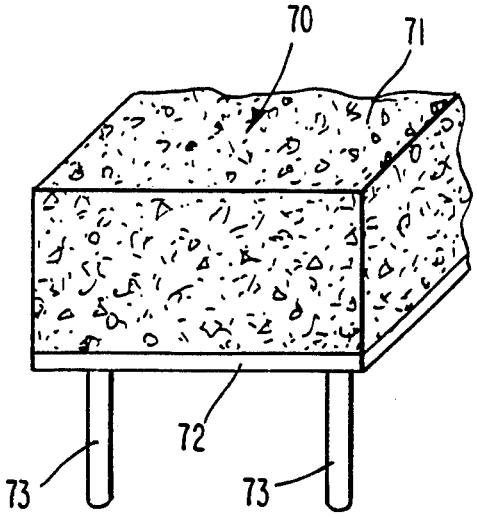
FIG. 7 is another alternative embodiment for the central bed portion, wherein its supports are legs to be carried on the deck between the spaced-apart separate beds.

With particular reference to FIG. 7, yet another alternative embodiment for a central bed portion 70 is shown, wherein a mattress portion 71 is mounted on a generally horizontal support 72. A plurality of legs 73 are provided, supporting the horizontal portion 72, with the legs 73 being adapted for disposition on the deck 21. In the arrangement of FIG. 7, the central bed portion 70 will not be carried on the separate beds, but on the floor, and will be of a size that it is generally confined against movement back and forth, between the separate beds 16, 17.

It will be apparent from the foregoing that various modifications may be made in the use and operation of the present invention without departing from the spirit and scope of the invention as defined in the claims. For example, various alternative constructions not specifically disclosed herein, may be used for the central bed portion, various constructions for the mattress, various constructions for the supports, etc., all within the scope of the invention.

It will also therefore be apparent that the present invention allows efficient use of limited space in a stateroom and allows considerable flexibility in meeting the requests of customers as to their preferences for separate beds or common, shared bed arrangements. Accordingly, with the present invention, there is a potential for realizing greater revenue by being able to accommodate a large number of passengers who desire larger beds, who desire shared bed arrangements, and particularly those desiring both situations; namely, common shared bed arrangements, in a setting in which the bed arrangement is significantly larger than even a customary double bed, and even larger than a customary queen-size or king-size bed.

With particular reference to FIG. 3, it will be seen that the spaced-apart individual beds are of a size, from side-to-side, as measured by the dimension "c". Typically, in staterooms, the dimension "c" is 36 inches. The space commonly taken up by the back supports 34, in each instance, is indicated by the letter "a", and such will generally be on the order of 4 inches. Therefore, even when the back supports 34 are in the phantom positions, a person sleeping on the shipboard bed 16 or 17, will only have 32 inches lateral use of the bed. A standard size single bed will ordinarily be 38 inches in width, leaving a person who is accustomed to sleeping on a standard single bed, a full six inches less sleeping room as measured across the bed.

In accordance with the present invention, reference will be made to the dimension "b" of FIG. 3, which dimension in many shipboard staterooms is typically 88 inches, having a space "d" between the beds 16, 17, that is 16 inches transverse measurement as shown in FIG. 3.

By utilizing the present invention with its central bed portion(s) 40, as shown, the total transverse dimension of the bedding area is thus measured as $2c+d$, or 88 inches less the distance *2a* as shown in FIG. 3. If $a=4$ inches, $c=36$ inches and $d=16$ inches, then the effective bed size in lateral dimension is 80 inches. Thus, with the present invention, the bedding size is effectively increased to be even larger than the standard width size of a queen-size bed 960 inches) and furthermore, even larger than the standard size of a king-size bed which is typically 76 inches in width. The lengths of the beds can be of standard length or as otherwise desired.

I claim:

1. In a paired bed arrangement for a shipboard cabin, stateroom or the like use, in which two relatively narrow beds are disposed with their long sides in spaced-apart generally parallel congruent relation to each other, and with at least one wall-mounted back support and a convertible center bed portion, and in which the beds of the pair each have a long side disposed adjacent a stateroom wall, wherein the beds of the pair are fixedly mounted relative to any of the stateroom walls adjacent thereto and deck, for preventing movement of any of the beds relative thereto, with their upper sleeping surfaces disposed in generally coplanar relationship in a generally given first plane, leaving a normally open space therebetween, wherein the at least one wall-mounted back support is mounted on a stateroom wall above at least one of the pair of beds, to facilitate use of at least one bed as a seating facility when the convertible center bed portion is removed relative to the pair of beds, the convertible center bed portion being in addition to the narrow beds and the at least one back support and being suitable for disposition between the pair of beds to be mounted in the normally open space therebetween, and means readily removably mounting said convertible center bed portion positioned between said pair of beds with its upper surface in substantially said first plane, whereby a pair of beds can readily, optionally, be converted to a single large bed having a width generally equivalent to the width of the pair of beds and the width of the open space without requiring movement of any of the narrow beds or the at least one back support.

2. The arrangement of claim 1, wherein each of the beds of the pair has a frame, with a mattress disposed on the frame, and with at least an elongate frame portion of each bed frame extending along the long side of the beds, generally facing toward said normally open space.

3. The arrangement of claim 2, wherein said mounting means comprises means mounting said convertible bed portion on said elongate frame portions.

4. The arrangement of claim 1, wherein said convertible bed portion comprises at least one support portion and at least one mattress portion.

5. The arrangement of claim 4, wherein there are a plurality of support portions and a plurality of mattress portions associated therewith.

6. The arrangement of claim 5, including means foldably connecting together at least some of said plurality of mattress portions and associated support portions.

7. The arrangement of claim 4, wherein each said bed of said pair has frame means, and with said mounting means for said convertible bed portion comprising means mounting said at least one convertible bed support portion to said frame portions.

8. The arrangement of claim 1, wherein said mounting means includes spacer means mounting said convertible bed portion spaced above the deck of the stateroom.

9. The arrangement of claim 8, wherein said spacer means includes legs.

10. The arrangement of claim 1, wherein each of the beds of the pair has a frame, with a mattress disposed on the frame, and with at least an elongate frame portion of each bed frame extending along the long side of the beds, generally facing toward said normally open space, and wherein said convertible bed portion comprises at least one support portion and at least one mattress portion.

11. A ship having staterooms that are readily convertible between a bed arrangement having a spaced-apart pair of beds and a bed arrangement having a bed larger than the total size of the spaced-apart pair of beds, for allowing flexibility in sleeping arrangements, comprising staterooms having:

a) a spaced-apart pair of beds, generally fixedly positioned in a stateroom in generally longitudinally parallel congruent arrangement relative to each other, leaving an open space therebetween, and with the upper sleeping surfaces of the beds being disposed in generally coplanar relation in a first plane, in which the beds of the pair each have a long side disposed adjacent a stateroom wall, and wherein the beds of the pair are fixedly mounted relative to any of the stateroom walls adjacent thereto and deck, for preventing movement of any of the beds relative thereto;

b) wherein at least one wall-mounted back support is mounted on a stateroom wall above at least one of the pair of beds, to facilitate use of at least one bed as a seating facility when a convertible bed portion is removed relative to the pair of bed; and c) a convertible center bed portion in addition to the narrow beds and the at least one back support, suitable for disposition between the pair of beds to be mounted in the normally open space therebetween, and means readily removably mounting said convertible center bed portion positioned between said pair of beds with its upper surface in substantially said first plane, whereby a pair of beds in any of a plurality of staterooms can readily, optionally by converted to a single large bed having a width generally equivalent to the width of the pair of beds and the width of the open space, without requiring movement of any of the narrow beds or the at least one back support, for flexibility in sleeping arrangements.

12. A ship in accordance with claim 11, wherein said convertible bed portion comprises at least one support portion and at least one mattress portion.

13. A ship in accordance with claim 12, wherein each said bed of said pair has frame means, and with said mounting means for said convertible bed portion comprising means mounting said at least one convertible bed support portion to said frame portions.

14. A process for optimizing shipboard bedding flexibility, comprising the steps of:

a) providing staterooms with a pair of narrow beds and at least one wall-mounted back support mounted on a stateroom wall above at least one of the pair of beds, to facilitate use of at least one bed as a seating facility when the convertible bed portion is removed relative to the pair of beds;

b) fixedly mounting the beds in the stateroom so that the beds are in spaced-apart, longitudinally parallel, generally congruent relation to each other with their long sides adjacent a stateroom wall, defining a longitudinal space there-between;

c) providing an optional center bed portion of a size to fit between the beds, in addition to the narrow beds and the at least one back support;

d) selectively and removably installing the center bed portion in the space between the beds, such that in the installed condition, the center bed portion and the two beds taken together define an upper bed surface in a generally common plane; and e) whereby a given stateroom may readily be converted between one providing spaced-apart separate smaller beds and one providing a single larger bed, for accommodating the needs of the user without requiring movement of any of the narrow beds or the at least one back support.

* * * * *

UNITED STATES PATENT OFFICE

CERTIFICATE OF CORRECTION

Patent No. 5,181,286 Dated January 26, 1993

Inventor(s) John F. McNulty

It is certified that error appears in the above-identified patent and that said Letters Patent is hereby corrected as shown below:

Column 5, line 37, "wall-mounted" should read -- wall-adjacent --
lines 46-47, "wall-mounted" should read -- wall-adjacent --.

Column 6, line 51, "wall-mounted" should read -- wall-adjacent --

Column 7, line 14, "wall-mounted" should read -- wall-adjacent --

Signed and Sealed this

Second Day of November, 1993

*Attest:*

Bruce Lehman

BRUCE LEHMAN

*Attesting Officer*

*Commissioner of Patents and Trademarks*